US009876283B2

(12) United States Patent
Crockett, Jr. et al.

(10) Patent No.: US 9,876,283 B2
(45) Date of Patent: Jan. 23, 2018

(54) ACTIVE ELECTRONICALLY SCANNED ARRAY ANTENNA

(71) Applicant: Raytheon Company, Waltham, MA (US)

(72) Inventors: John A. Crockett, Jr., Anaheim, CA (US); David W. Francel, Hawthorne, CA (US); Amanda N. Berkes, Los Alamitos, CA (US)

(73) Assignee: RAYTHEON COMPANY, Waltham, MA (US)

( * ) Notice: Subject to any disclaimer, the term of this patent is extended or adjusted under 35 U.S.C. 154(b) by 575 days.

(21) Appl. No.: 14/309,339

(22) Filed: Jun. 19, 2014

(65) Prior Publication Data

US 2015/0372394 A1 Dec. 24, 2015

(51) Int. Cl.

| | |
|---|---|
| ***H01Q 21/06*** | (2006.01) |
| ***H01Q 3/24*** | (2006.01) |
| ***H01Q 13/08*** | (2006.01) |
| ***H01Q 21/00*** | (2006.01) |

(52) U.S. Cl.

CPC ..... *H01Q 21/061* (2013.01); *H01Q 3/24* (2013.01); *H01Q 13/085* (2013.01); *H01Q 21/0087* (2013.01); *H01Q 21/064* (2013.01)

(58) Field of Classification Search

CPC ..... H01Q 21/061; H01Q 21/064

See application file for complete search history.

(56) References Cited

U.S. PATENT DOCUMENTS

| | | | |
|---|---|---|---|
| 3,935,548 | A | 1/1976 | Rosenbaum et al. |
| 5,086,304 | A | 2/1992 | Collins |
| 5,703,599 | A | 12/1997 | Quan et al. |
| 5,936,579 | A | 8/1999 | Kapitsyn |
| 6,127,984 | A | 10/2000 | Klebe et al. |
| 6,219,000 | B1 | 4/2001 | McWhirter et al. |
| 6,388,631 | B1 | 5/2002 | Livingston et al. |

(Continued)

FOREIGN PATENT DOCUMENTS

| | | |
|---|---|---|
| JP | 63305538 | 12/1988 |
| WO | 2009005912 A1 | 1/2009 |

OTHER PUBLICATIONS

Antenna Theory: A Review, Balanis, Proc. IEEE vol. 80 No. 1 Jan 1992.*

Final Office Action issued in U.S. Appl. No. 13/483,404; dated Jul. 17, 2015; 18 pages.

(Continued)

*Primary Examiner* — Robert Karacsony

*Assistant Examiner* — Amal Patel

(74) *Attorney, Agent, or Firm* — Cantor Colburn LLP

(57) ABSTRACT

An antenna is provided and includes a plate and an aperture assembly attached to the plate. The aperture assembly includes sticks that respectively include a spacer, a carrier formed separately from the spacer and on which circulators are disposed, a base defining recesses from which bosses interleaved with the recesses protrude and fasteners disposed to fasten the spacer to the base at boss locations with the carrier interposed between the spacer and the base and the circulators aligned with the recesses. The aperture assembly further includes conductive elements extending through the plate and the base for electric coupling to the circulators. Adjacent sticks define a slot extending forwardly from the plate. The slot is notched at a corresponding circulator and rounded forwardly from the corresponding circulator.

9 Claims, 3 Drawing Sheets

(56) References Cited

U.S. PATENT DOCUMENTS

| | | | | |
|---|---|---|---|---|
| 6,480,167 | B2 | 11/2002 | Matthews | |
| 6,600,453 | B1 | 7/2003 | Hadden, IV et al. | |
| 6,653,984 | B2 | 11/2003 | Park et al. | |
| 6,781,554 | B2 | 8/2004 | Lee et al. | |
| 7,109,943 | B2 | 9/2006 | McCarville | |
| 7,315,288 | B2 | 1/2008 | Livingston et al. | |
| 7,417,598 | B2 | 8/2008 | Navarro et al. | |
| 7,764,236 | B2 | 7/2010 | Hill | |
| 7,889,147 | B2 | 2/2011 | Tam | |
| 8,717,243 | B2 | 5/2014 | Yaccarino et al. | |
| 2005/0088353 | A1 | 4/2005 | Irion et al. | |
| 2005/0264448 | A1 | 12/2005 | Cox | |
| 2012/0068906 | A1 | 3/2012 | Asher et al. | |
| 2013/0176186 | A1 | 7/2013 | Yaccarino et al. | |
| 2013/0183913 | A1* | 7/2013 | Tevell | H01Q 1/1207 455/90.3 |
| 2013/0321228 | A1 | 12/2013 | Crockett, Jr. et al. | |
| 2015/0002354 | A1 | 1/2015 | Knowles | |

OTHER PUBLICATIONS

Non-Final Office Action issued in U.S. Appl. No. 13/483,404; dated Feb. 23, 2015; 20.
Extended European Search Report issued in 13796807.9, dated Dec. 15, 2015; 8 pages.
Search Report issue in PCT/US13/34269 dated Jun. 10, 2013.
Written Opinion issued in PCT/US13/34269 dated Jun. 10, 2013.
International Search Report issued in PCT/US2015/025538 dated Nov. 26, 2015; 5 pages.
Written Opinion issued in PCT/US2015/025538 dated Nov. 26, 2015; 6 pages.

* cited by examiner

ACTIVE ELECTRONICALLY SCANNED ARRAY ANTENNA

STATEMENT OF GOVERNMENT INTEREST

This invention was made with government support under a confidential government contract (contract number withheld) awarded by the Department of Defense. The government has certain rights in the invention.

BACKGROUND

The subject matter disclosed herein relates to an active electronically scanned array (AESA) antenna and, more particularly, to connector stick packaging for a long slot aperture of a radiator of an AESA antenna.

An active electronically scanned array (AESA) antenna is an antenna including multiple radiators. The relative amplitude and phase of each of the radiators can be controlled so that transmit or receive beams can be electronically steered without the need for physically or mechanically moving the antenna. Such an antenna includes an aperture for transmitting or receiving waves traveling in free space and may include back-end circuitry having electronics modules for generating signals to be transmitted and for processing received signals.

SUMMARY

According to one aspect, an antenna is provided and includes a plate and an aperture assembly attached to the plate. The aperture assembly includes sticks that respectively include a spacer, a carrier formed separately from the spacer and on which circulators are disposed, a base defining recesses from which bosses interleaved with the recesses protrude and fasteners disposed to fasten the spacer to the base at boss locations with the carrier interposed between the spacer and the base and the circulators aligned with the recesses. The aperture assembly further includes conductive elements extending through the plate and the base for electric coupling to the circulators. Adjacent sticks define a slot extending forwardly from the plate. The slot is notched at a corresponding circulator and rounded forwardly from the corresponding circulator.

According to another aspect, a radiator stick of a radiator aperture assembly of an antenna is provided. The radiator stick includes a spacer, a carrier formed separately from the spacer and on which circulators are disposed, a base defining recesses from which bosses interleaved with the recesses protrude and fasteners disposed to fasten the spacer to the base at boss locations with the carrier interposed between the spacer and the base and the circulators aligned with the recesses.

According to yet another aspect, a circulator of a radiator aperture assembly of an antenna is provided. The circulator includes a substrate having a substantially rectangular shape including first and second opposite, parallel longitudinal edge portions and first and second opposite, parallel side edge portions respectively extending between the first and second longitudinal edge portions, a conductive layer disposed on a surface of the substrate and a magnetic element disposed on the conductive layer.

These and other advantages and features will become more apparent from the following description taken in conjunction with the drawings.

BRIEF DESCRIPTION OF THE DRAWINGS

The subject matter disclosed herein is particularly pointed out and distinctly claimed in the claims at the conclusion of the specification. The foregoing and other features and advantages are apparent from the following detailed description taken in conjunction with the accompanying drawings in which:

The detailed description explains embodiments of the invention, together with advantages and features, by way of example with reference to the drawings.

DETAILED DESCRIPTION

A new or retrofit radiator assembly is provided for use with new or existing antenna arrays as well as other applications that may have relatively wide lattice configurations. Where it is being used as a retrofit radiator assembly, the radiator assembly can serve as a "drop in" replacement for old radiators and thus requires little to no modifications to antenna hardware. Antenna gain, radio frequency (RF) polarization and scanning performance are maintained or improved. As will be discussed below, the radiator assembly includes several features that are similar to features of the radiator assembly described in U.S. patent application Ser. No. 13/483,404, which was filed on May 30, 2012. The entire disclosure of U.S. patent application Ser. No. 13/483,404 is incorporated herein by reference.

Figure 1:
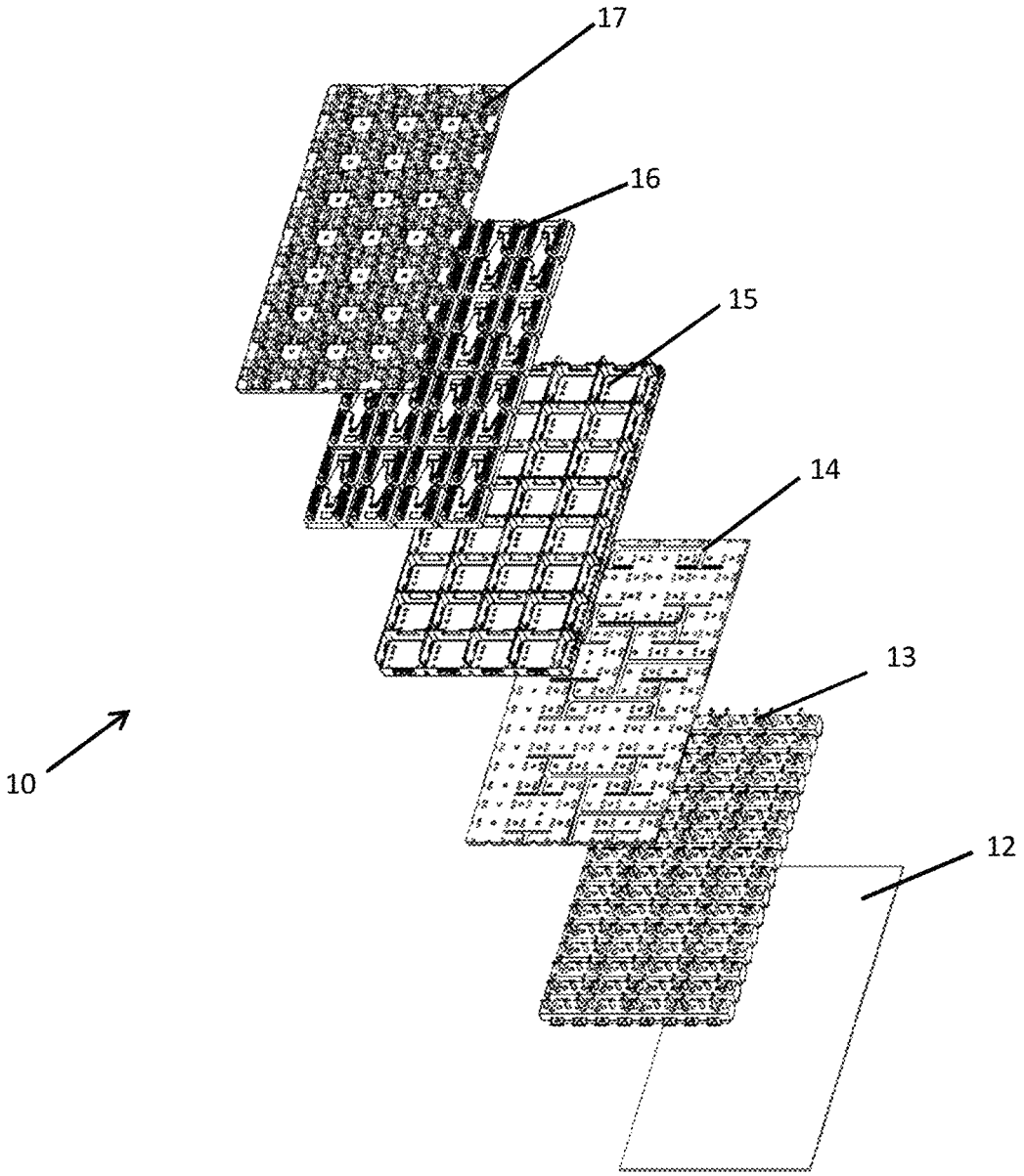
FIG. 1 is a perspective view of an antenna in accordance with embodiments.

With reference to FIG. 1, an active electronically scanned array (AESA) antenna 10 is provided and includes a radome 12, a radiator aperture assembly 13, a plate 14, which serves as a corporate feed or a power divider, a coldwall 15, transmit/receive (T/R) modules 16, a motherboard 17 and an aft cover (not shown). The radome 12 forms a forward end of the antenna 10 whereby electromagnetic radiation is transmitted and/or received. The aft cover forms an aft end of the antenna 10 in which the T/R modules 16 and the motherboard 17 are disposed to perform certain electronic functions. In particular, the motherboard 17 provides a DC signal and power distribution network by which the T/R modules 16 can be controlled. The radiator aperture assembly 13, the plate 14 and the coldwall 15 are operably disposed between the forward and aft ends of the antenna 10.

As shown in FIG. 1, the antenna 10 as a whole can have a rectangular shape with the radiator aperture assembly 13 having a similarly rectangular shape. This is not required, however, and it is to be understood that the antenna 10 can have various overall shapes with the radiator aperture assembly having similar or different shapes as well.

Figure 2:
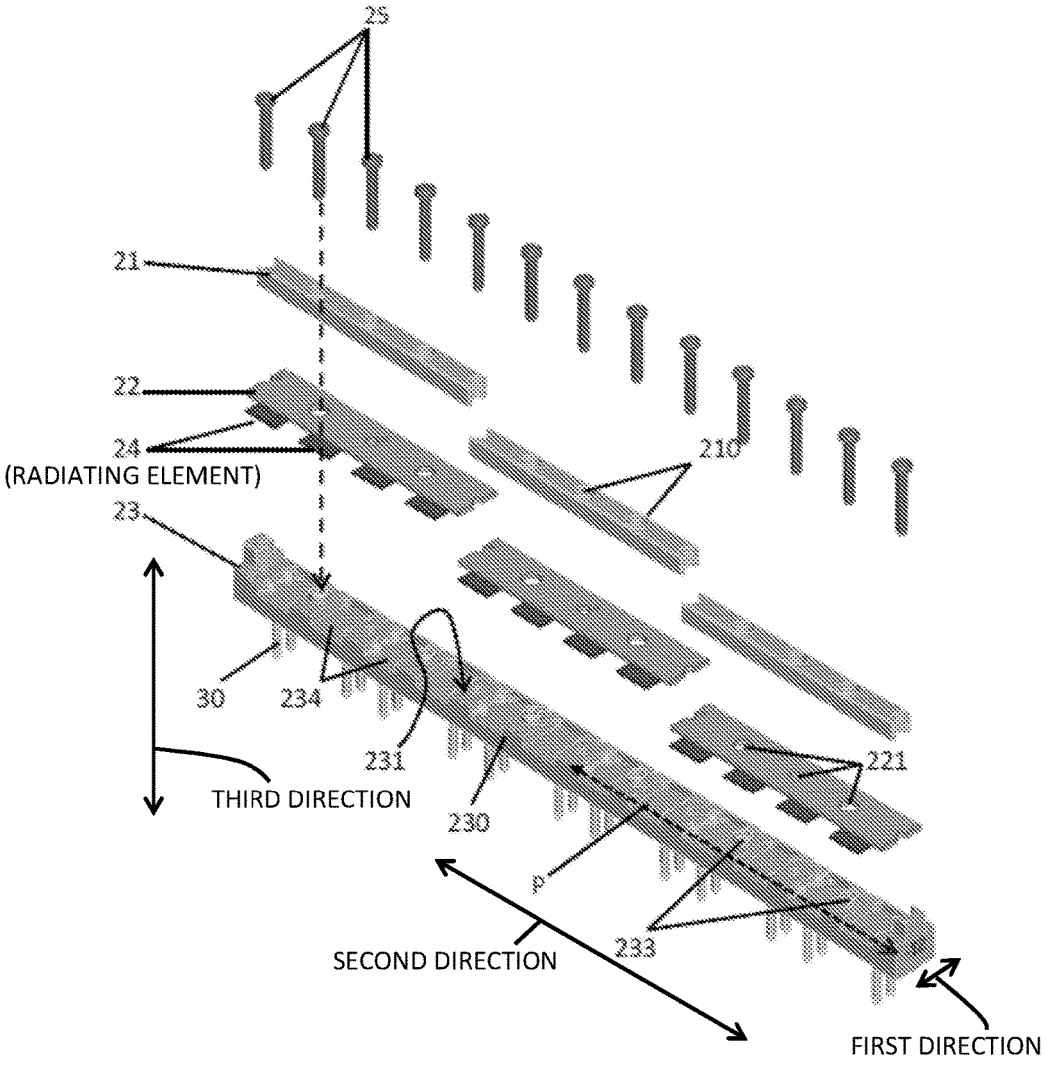
FIG. 2 is a perspective exploded view of a radiator stick of the antenna of FIG. 1 in accordance with embodiments.
Figure 3:
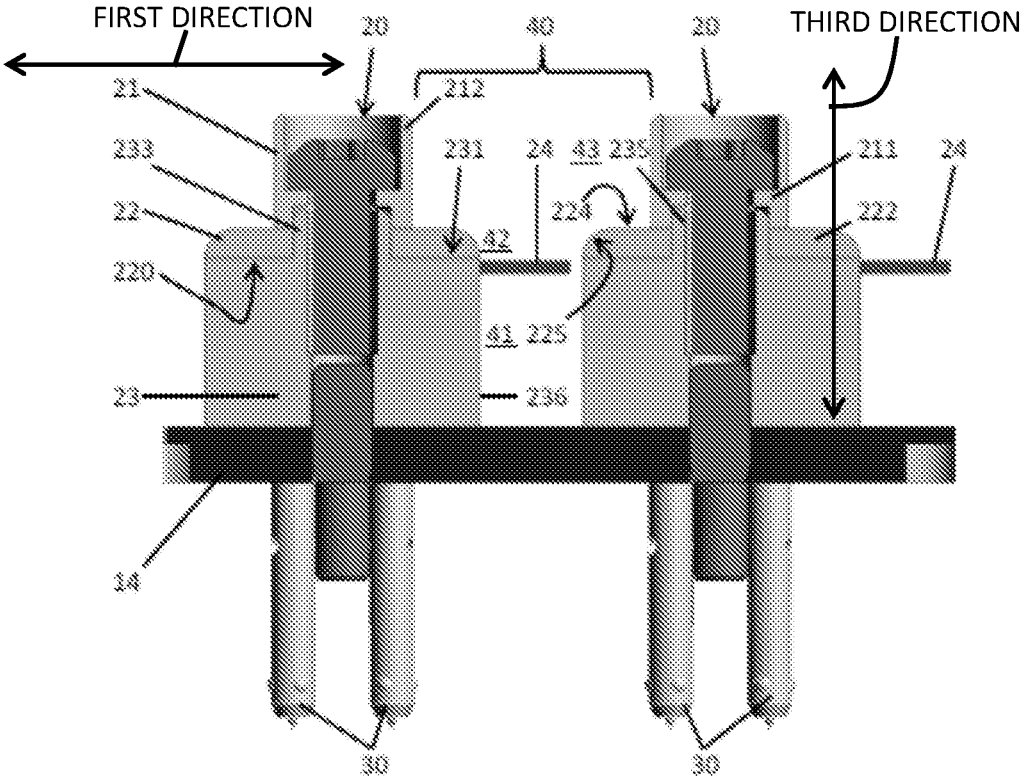
FIG. 3 is a side view of a pair of adjacent radiator sticks and a plate of the antenna of FIG. 1 in accordance with embodiments.

With reference to FIGS. 2 and 3, the antenna 10 is assembled in various stages including an initial stage during which a plurality of radiator "sticks" 20 of the radiator aperture assembly 13 are assembled and later stages during which the radiator aperture assembly 13 is attached to the plate 14. In accordance with embodiments, each radiator stick 20 includes a radiator spacer 21, a radiator carrier strip 22 and a radiator base 23. The radiator carrier strip 22 is formed separately from the radiator spacer 21 and has a surface 220 on which radiating elements or circulators 24 (hereinafter generally referred to as "circulators 24") are disposed to extend in a first direction (see FIGS. 2 and 3) in a longitudinal array. The radiator base 23 extends longitudinally along a second direction (see FIG. 2) and includes a body 230 that has a forward surface 231 and an aft surface 232 opposite the forward surface 231. The forward surface 231 defines a plane P. The radiator base 23 further includes a longitudinal array of bosses 233 that each protrude from the forward surface 231 in a third direction (see FIGS. 2 and 3) while the body 230 is formed to define a longitudinal array of recesses 234 that are each recessed from the plane P. The recesses 234 are interleaved with the bosses 233.

Each radiator stick 20 further includes fasteners 25 that are disposed to fasten the radiator spacer 21 to the radiator base 23 at respective locations of each of the bosses 233 during the initial stage. This fastening is conducted such that the radiator carrier strip 22 is interposed between the radiator spacer 21 and the radiator base 23 and such that the circulators 24 are respectively aligned with corresponding ones of the recesses 234. The fasteners 25 may be provided as threaded screws, for example. During the later stages, conductive elements 30 are disposed to extend through the plate 14 and the radiator base 23 so that they may be respectively electrically coupled to corresponding ones of the circulators 24. In accordance with embodiments pairs of conductive elements 30 may be disposed in association with respective ones of the circulators 24 and, in each pair, the conductive elements 30 may be offset, straight or mixed.

In accordance with embodiments, the radiator spacer 21 is formed to define a longitudinal array of first through-holes 210, the radiator carrier 22 is formed to define a longitudinal array of second through-holes 221, which are interleaved with the circulators 24, and the bosses 233 are respectively aligned with corresponding ones of the first through-holes 210 and the second through-holes 221. In accordance with further embodiments, the longitudinal array of the second through-holes 221 may include through-holes of a first size and through-holes of a second size, which are sized differently from (i.e., larger than) the through-holes of the first size. In such cases, the bosses 233 may be disposed for alignment with the larger sized second through-holes 221 with the radiator base 23 being further formed to define through-holes disposed for alignment with the smaller sized second through-holes 221.

As shown in FIGS. 2 and 3, the bosses 233 may respectively include rims 235 that are hollow and which lead to through-holes extending through the body 230. The rims 235 are disposed to extend forwardly from the plane P, through the larger sized second through-holes 221 and into the first through-holes 210. In this way, the radiator carrier 22 (and the circulators 24) may be self-aligned with the radiator base 23. The radiator spacer 21 includes stoppers 211 that are respectively disposed within corresponding ones of the first through-holes 210 to abut forward edges of the rims 235. During the initial stage, respective fasteners 25 extend through the corresponding one of the first and second through-holes 210, 221 and through at least the hollow defined by the rims 235. The fastener 25 can then be rotated in a tightening direction such that a head portion thereof forces the stopper 211 toward the rim 235 in a tightening manner and squeezes the radiator carrier 22 between an aft edge of the radiator spacer 21 and the forward surface 231.

As shown in FIG. 3, once the later stages are complete and the conductive elements 30 are respectively electrically coupled to corresponding ones of the radiating elements or circulators 24 and the radiator aperture assembly 13 is attached to the plate 14, adjacent radiator sticks 20 cooperatively define a radiator slot 40. This radiator slot 40 extends forwardly from the plate 14 and is notched at a location of a corresponding circulator 24, which extends from a mid-point of the surface 220 of the radiator carrier strip 22 into the radiator slot 40, and is rounded forwardly in opposite directions from the location of the corresponding circulator 24.

In accordance with embodiments, the radiator spacer 21 has opposite sidewalls 212 that are substantially parallel with one another and planar such that the sidewalls 212 are disposable to extend normally with respect to the plate 14. In a similar fashion, the radiator base 23 has opposite sidewalls 236 that are substantially parallel with one another and planar such that the sidewalls 212 are disposable to extend normally with respect to the plate 14. The radiator carrier 22 includes a body 222 that has a first, aft facing planar surface (i.e., the surface 220) and a second, forward facing planar surface 224, which is opposite the surface 220, and opposite, curved sidewalls 225. The sidewalls 225 each curvi-linearly extend from the surface 220 to the second surface 224.

With the configuration described above, the radiator slot 40 includes a straight, relatively narrow aft portion 41 between the plate 14 and the corresponding circulator 24, a rounded portion 42 extending forwardly from the corresponding circulator 24; and a straight, relatively wide forward portion 43 extending forwardly from a terminus of the rounded portion 42. The aft portion 41 is defined between complementary sidewalls 236 of the radiator bases 23. The forward portion 43 is defined between complementary sidewalls 212 of the radiator spacers 21. The rounded portion 42 is defined between complementary sidewalls 225 of the radiator carriers 22.

Figure 4:
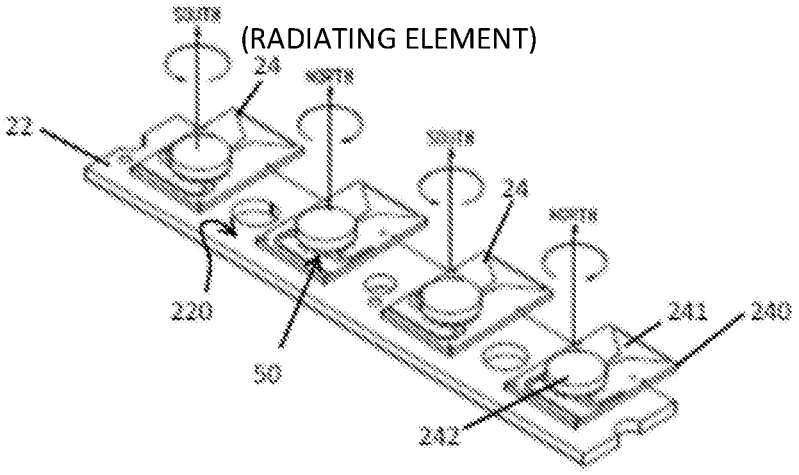
FIG. 4 is a perspective view of a carrier of the radiator stick of FIG. 2 in accordance with embodiments.

With reference to FIG. 4, the circulators 24 may be disposed on the surface 220 of the radiator carrier 22 in groups of four with four fasteners 25 used to fasten the radiator spacer 21 and the radiator carrier 22 to the radiator base 23. Also, in accordance with embodiments, each circulator 24 may have a substantially rectangular shape and is magnetically mirrored with respect to an adjacent circulator 24 on the surface 220.

Each circulator 24 includes a substrate 240, a conductive layer 241 and a magnetic element 242. The conductive layer 241 is disposed on a surface of the substrate 240 and the magnetic element 242 is disposed on the conductive layer 241. The magnetic element 242 may be provided as a permanent magnet 50 having either north or south polarity. The substrate 240 has a substantially rectangular shape and includes first and second longitudinal edge portions that are opposite and parallel with each other and first and second side edge portions that are opposite and parallel with each other. The first and second side edge portions respectively extend between opposite ends of the first and second longitudinal edge portions.

With the configurations described above, the radiator aperture assembly 13 has certain advantages over conventional assemblies. These advantages include, but are not limited to, the circulators 24 being self-aligned by the extension of the rims 235 through the larger sized second through-holes 221, the fact that tolerance requirements can be met without large bonding pads or associated wire bonds, the fact that assembly and mounting of the radiator sticks 20 can be completed at the array level with a limited number of fasteners 25 (e.g., screws) and the simplification of assembly processes. Additional advantages include the building of long radiator slot 40 geometry into the separate radiator spacer 21, radiator carrier 22 and radiator base 23, the bosses 233 permit and facilitate disassembly and reassembly of the radiator aperture assembly 13, part costs and assembly labor are reduced, the concentric alignment features (i.e., the bosses 233 and the second through-holes 21) allow for the use of threaded fasteners 25 and, in turn, allows for coefficient of thermal expansion (CTE) mismatch between components (i.e., chromated aluminum conductive elements and a stainless steel circulator carrier).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments have been described, it is to be understood that aspects may include only some of the described embodiments. Accordingly, the invention is not to be seen as limited by the foregoing description, but is only limited by the scope of the appended claims.

The invention claimed is:

1. An antenna, comprising:

a plate; and an aperture assembly attached to the plate, the aperture assembly comprising a plurality of radiator sticks arrayed side-by-side in a first direction with each one of the plurality of radiator sticks being elongate in a second direction transverse to the first direction and respectively comprising:

a spacer;

a carrier formed separately from the spacer and on which circulators are disposed, each circulator comprising a substrate, a conductive layer disposed on the substrate and a magnetic element disposed on the conductive layer;

a base defining recesses from which bosses interleaved with the recesses protrude; and fasteners disposed to fasten the spacer to the base at locations of the bosses with the carrier interposed between the spacer and the base and with the circulators aligned with the recesses, the antenna further comprising conductive elements extending through the plate and the base for electric coupling to the circulators, wherein adjacent ones of the plurality of radiator sticks are configured to cooperatively define a slot that extends along the first direction and forwardly in a third direction transverse to the first and second directions from the plate and which is notched and curved forwardly in the third direction at and from the corresponding circulator.

2. The antenna according to claim 1, wherein the corresponding circulator extends into the slot.

3. The antenna according to claim 1, wherein the spacer defines an array of first through-holes, the carrier defines an array of second through-holes interleaved with the circulators and the bosses are aligned with the first and second through-holes.

4. The antenna according to claim 3, wherein the second through-holes comprise first and second differently sized through-holes interleaved with one another.

5. The antenna according to claim 3, wherein the bosses respectively comprise rims disposed to extend through the second through-holes and into the first through-holes and the spacer comprises stoppers respectively disposed within the first through-holes to abut the rims.

6. The antenna according to claim 1, wherein four circulators are disposed on the carrier.

7. The antenna according to claim 1, wherein the carrier comprises:

a body having opposite planar surfaces; and opposite, curved sidewalls extending between the opposite planar surfaces.

8. The antenna according to claim 1, wherein the slot comprises:

a straight, relatively narrow aft portion between the plate and the corresponding circulator;

a rounded portion extending forwardly from the corresponding circulator; and a straight, relatively wide forward portion extending forwardly from a terminus of the rounded portion.

9. The antenna according to claim 1, wherein each stick comprises pairs of conductive elements associated with each circulator.

* * * * *